US009052112B2

(12) United States Patent
Berry et al.

(10) Patent No.: US 9,052,112 B2
(45) Date of Patent: Jun. 9, 2015

(54) COMBUSTOR AND METHOD FOR PURGING A COMBUSTOR

(75) Inventors: Jonathan Dwight Berry, Simpsonville, SC (US); Michael John Hughes, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 673 days.

(21) Appl. No.: 13/405,564

(22) Filed: Feb. 27, 2012

(65) Prior Publication Data

US 2013/0219912 A1 Aug. 29, 2013

(51) Int. Cl.

| | |
|---|---|
| ***F02C 7/00*** | (2006.01) |
| ***F23R 3/10*** | (2006.01) |
| ***F23R 3/28*** | (2006.01) |
| *F23R 3/32* | (2006.01) |

(52) U.S. Cl.

CPC . *F23R 3/10* (2013.01); *F23R 3/286* (2013.01); *F23D 2209/30* (2013.01)

(58) Field of Classification Search

CPC ..... F23R 3/32; F23R 3/286
USPC ..... 60/737, 740, 742, 746, 39.37; 239/132.5, 419, 419.3, 419.5, 423, 239/427, 427.3, 427.5, 424

See application file for complete search history.

(56) References Cited

U.S. PATENT DOCUMENTS

| | | | | |
|---|---|---|---|---|
| 3,771,500 | A | | 11/1973 | Shakiba |
| 4,104,873 | A | | 8/1978 | Coffinberry |
| 4,412,414 | A | | 11/1983 | Novick et al. |
| 5,104,310 | A | | 4/1992 | Saltin |
| 5,205,120 | A | | 4/1993 | Obländer et al. |
| 5,213,494 | A | | 5/1993 | Jeppesen |
| 5,218,824 | A | * | 6/1993 | Cederwall et al. ..... 60/737 |
| 5,341,645 | A | | 8/1994 | Ansart et al. |
| 5,400,968 | A | * | 3/1995 | Sood ..... 239/132.5 |
| 5,404,711 | A | * | 4/1995 | Rajput ..... 60/39.463 |
| 5,439,532 | A | | 8/1995 | Fraas |
| 5,467,926 | A | * | 11/1995 | Idleman et al. ..... 239/132.5 |
| 5,592,819 | A | | 1/1997 | Ansart et al. |
| 5,707,591 | A | | 1/1998 | Semedard et al. |
| 6,098,407 | A | | 8/2000 | Korzendorfer et al. |
| 6,123,542 | A | | 9/2000 | Joshi et al. |
| 6,394,791 | B2 | | 5/2002 | Smith et al. |
| 6,438,961 | B2 | | 8/2002 | Tuthill et al. |
| 6,796,790 | B2 | | 9/2004 | Venizelos et al. |
| 6,983,600 | B1 | | 1/2006 | Dinu et al. |
| 7,003,958 | B2 | | 2/2006 | Dinu et al. |
| 7,007,478 | B2 | | 3/2006 | Dinu |
| 7,631,499 | B2 | | 12/2009 | Bland |
| 7,752,850 | B2 | | 7/2010 | Laster et al. |
| 8,234,871 | B2 | * | 8/2012 | Davis et al. ..... 60/737 |
| 8,312,722 | B2 | * | 11/2012 | York et al. ..... 60/737 |
| 2004/0216463 | A1 | | 11/2004 | Harris |
| 2008/0016876 | A1 | | 1/2008 | Colibaba-Evulet et al. |
| 2008/0304958 | A1 | | 12/2008 | Norris et al. |
| 2009/0297996 | A1 | | 12/2009 | Vatsky et al. |

(Continued)

*Primary Examiner* — Phutthiwat Wongwian
*Assistant Examiner* — Eric Linderman
(74) *Attorney, Agent, or Firm* — Dority & Manning, PA

(57) ABSTRACT

A combustor includes an end cap. The end cap includes a first surface and a second surface downstream from the first surface, a shroud that circumferentially surrounds at least a portion of the first and second surfaces, a plate that extends radially within the shroud, a plurality of tubes that extend through the plate and the first and second surfaces, and a first purge port that extends through one or more of the plurality of tubes, wherein the purge port is axially aligned with the plate.

17 Claims, 2 Drawing Sheets

(56) References Cited

U.S. PATENT DOCUMENTS

| | | | | |
|---|---|---|---|---|
| 2010/0008179 | A1 | 1/2010 | Lacy et al. | |
| 2010/0024425 | A1* | 2/2010 | Cihlar et al. | 60/734 |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0101204 | A1* | 4/2010 | Berry et al. | 60/39.53 |
| 2010/0139280 | A1 | 6/2010 | Lacey et al. | |
| 2010/0186413 | A1 | 7/2010 | Lacey et al. | |
| 2010/0192581 | A1* | 8/2010 | Ziminsky et al. | 60/737 |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0263381 | A1* | 10/2010 | Ishizaka et al. | 60/737 |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1* | 4/2011 | Zuo et al. | 60/737 |
| 2011/0089266 | A1 | 4/2011 | Stoia et al. | |
| 2011/0265482 | A1* | 11/2011 | Parsania et al. | 60/740 |
| 2012/0011854 | A1* | 1/2012 | Khan et al. | 60/772 |
| 2012/0023964 | A1* | 2/2012 | Mehring | 60/776 |
| 2012/0111013 | A1* | 5/2012 | Parsania et al. | 60/737 |

* cited by examiner

COMBUSTOR AND METHOD FOR PURGING A COMBUSTOR

FEDERAL RESEARCH STATEMENT

This invention was made with Government support under Contract No. DE-FC26-05NT42643, awarded by the Department of Energy. The Government has certain rights in this invention.

FIELD OF THE INVENTION

The present invention generally involves a combustor and a method for purging a combustor.

BACKGROUND OF THE INVENTION

Combustors are commonly used in industrial and power generation operations to ignite fuel to produce combustion gases having high temperatures and pressures. Various competing considerations influence the design and operation of combustors. For example, higher combustion gas temperatures generally improve the thermodynamic efficiency of the gas turbine. However, higher combustion gas temperatures also promote flashback or flame holding conditions in which the combustion flame migrates towards the fuel being supplied by nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of tubes may be arranged radially in an end cap to provide fluid communication for a working fluid to flow through the end cap and into a combustion chamber. A fuel may be supplied to a fuel plenum inside the end cap. The fuel flows over the outside of the tubes before flowing through a plurality of fuel injection ports and into the tubes to mix with the working fluid. The enhanced mixing between the fuel and working fluid in the tubes allows leaner combustion at higher operating temperatures while protecting against flashback or flame holding and controlling undesirable emissions. However, in certain combustor designs, the fuel may leak from the fuel plenum and become trapped in a volume within the end cap, and the working fluid velocity may be insufficient to purge the trapped fuel from the end cap. As a result, the working fluid and fuel may create conditions conducive to flashback and/or flame holding events. Therefore, an improved combustor and method for purging fuel from the combustor that minimizes the risk of a flashback event would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap. The end cap includes a first surface and a second surface downstream from the first surface, a shroud that circumferentially surrounds at least a portion of the first and second surfaces, a plate that extends radially within the shroud, a plurality of tubes that extend through the plate and the first and second surfaces, and a first purge port that extends through one or more of the plurality of tubes, wherein the purge port is axially aligned with the plate.

A second embodiment of the present invention is a combustor that includes an end cap, a plurality of tubes that extend through the end cap and provide fluid communication through the end cap, a plate that extends radially inside the end cap, and a first purge port between the plate and one or more of the plurality of tubes, wherein the first purge port provides fluid communication into the one or more of the plurality of tubes.

Embodiments of the present invention may also include a method for purging a combustor that includes flowing a working fluid through a plurality of tubes that extend axially through an end cap, flowing a fuel into the plurality of tubes, and flowing at least a portion of the working fluid through a diluent plenum located inside the end cap and into one or more of the plurality of tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
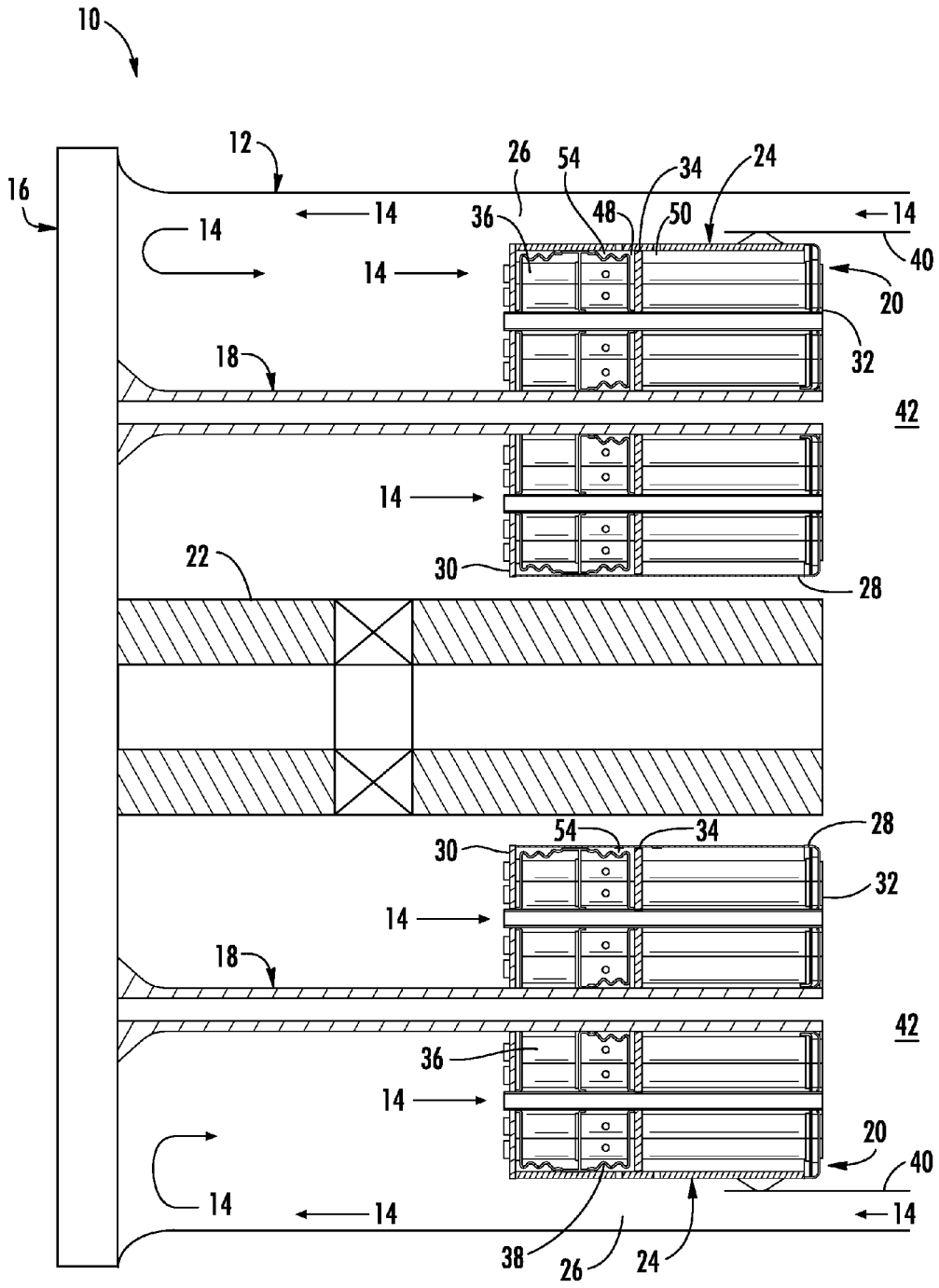
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for purging fuel from the combustor. The combustor generally includes an end cap and a plurality of tubes that extend through the end cap to provide fluid communication through the end cap. One or more plates extend radially inside the end cap to at least partially define one or more diluent plenums inside the end cap. One or more tubes may include one or more purge ports that provide fluid communication from the one or more diluent plenums into the tubes. In particular embodiments, the purge ports may be axially aligned with the plate. In this manner, at least a portion of a working fluid flowing through the one or more diluent plenums may allow trapped fuel or other gases in low velocity areas inside the end cap to be directed through the purge ports, thus reducing the buildup of fuel inside the end cap. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
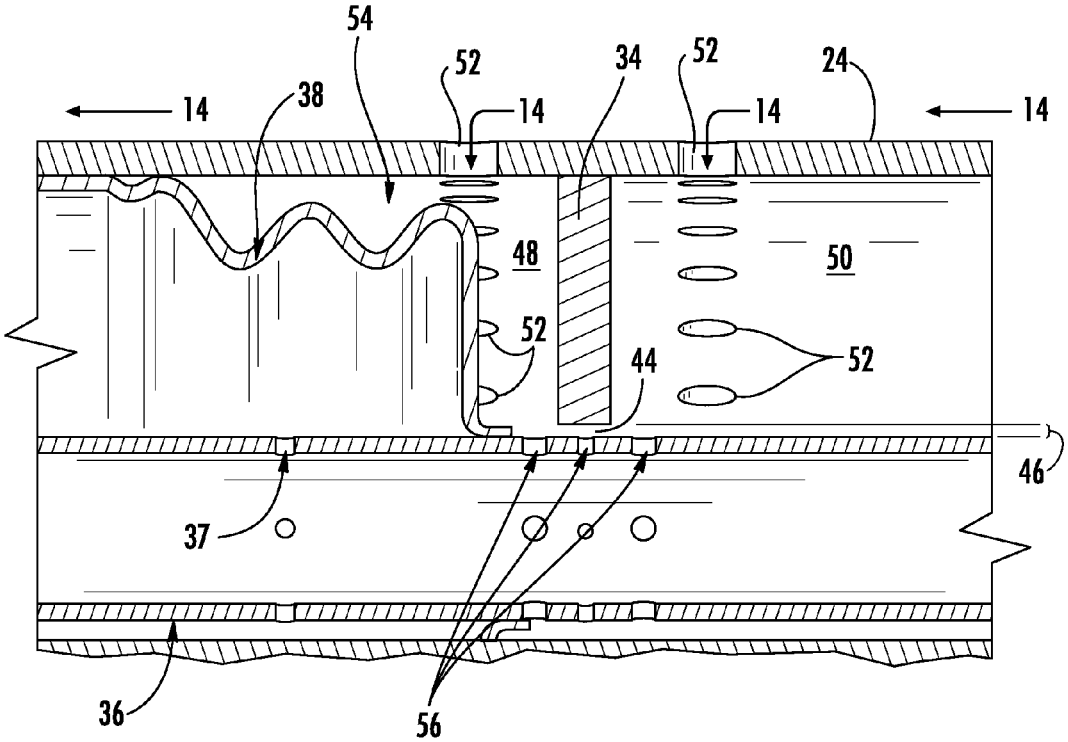
FIG. 2 is an enlarged cross-section view of a portion of the combustor as shown in FIG. 1.

FIG. 1 provides a simplified cross-section view of an exemplary combustor 10 according to one embodiment of the present invention and FIG. 2 provides an enlarged cross-section view of a portion of the combustor as shown in FIG. 1. As shown in FIG. 1, a casing 12 generally surrounds the combustor 10 to contain a working fluid 14 flowing to the combustor 10. The casing 12 may include an end cover 16 at one end to provide an interface for supplying fuel, diluent, and/or other additives to the combustor 10. At least one fluid conduit 18 may extend axially downstream from the end cover 16 to provide fluid communication between the end cover 16 and at least one fuel nozzle 20. The fluid conduit 18 may be configured to flow a fuel, a diluent, and/or other additives to the fuel nozzle 20 and/or the combustor. In particular embodiments, the combustor may include a center fuel nozzle 22 extending axially downstream from the end cover 16 along an axial centerline of the end cover 16. A shroud 24 may circumferentially surround the fuel nozzle 20 to at least partially define an annular passage 26 between the casing 12 and the fuel nozzle 20. In particular embodiments, the shroud may extend axially between the end cap 28 first surface 30 to the end cap second surface 32.

An end cap 28 disposed downstream from the end cover 16 includes a first surface 30 axially separated from a second surface 32 downstream of the first surface 30. The end cap 28 may be configured to extend radially across at least a portion of the combustor 10. The end cap 28 first and second surfaces 30 & 32 respectfully, may be at least partially circumferentially surrounded by the shroud 24. At least one plate 34 may extend generally radially within the shroud 24. A plurality of tubes 36 may extend through the plate 34 and the first and second surfaces 30 & 32 respectfully, to provide fluid communication through the end cap 28. As shown in FIG. 2, the tubes 36 may include one or more fuel ports 37 providing fluid communication from a fuel plenum 38, generally disposed within the end cap 28, into the tubes 36. The fuel ports 37 may be angled radially, axially, and/or azimuthally to project and/or impart swirl to the fuel flowing through the fuel ports 37 and into the tubes 36.

As shown in FIGS. 1 and 2, the fuel plenum 38 may be connected to one or more of the tubes 36 and may be at least partially surrounded by the shroud 24. As shown in FIG. 1, the end cap 28 and a flow sleeve 40 generally define a combustion chamber 42 downstream from the end cap 28. In this manner, the working fluid 14 may flow through the annular passage 26 along the outside of the shroud 24 to provide convective cooling to the shroud 24. In particular embodiments, the shroud may also include at least one diluent port 52 extending through the shroud. In this manner, the working fluid may provide a purging medium to the fuel nozzle 20. When the working fluid 14 reaches the end cover 16, the working fluid 14 may reverse direction to flow through the end cap 28 and/or at least one of the tubes 36 and into the combustion chamber 42.

As shown in FIG. 2 the plate 34 may define at least one tube passage 44 extending axially through the plate 34. The tube passage 44 may be of any size and/or shape to accommodate various sizes and shapes of the tubes 36 and the tube passage 44 may be in any configuration to complement the tubes 36. In particular embodiments, the tube passage 44 may provide a radial gap 46 between the each of the plurality of tubes 36 and the plate 34. The radial gap 46 may be sufficiently sized to allow the working fluid and/or a fuel to flow therebetween. The plate 34 may at least partially define one or more diluent plenums within the end cap. For example, as shown in FIGS. 1 and 2, the first surface of the end cap 30, the shroud 24 and the plate 34 may form a first diluent plenum 48 within the end cap 28, and the plate 34, the shroud 24 and the second surface of the end cap may form a second diluent plenum 50 within the end cap 28. In particular embodiments, the at least one diluent port 54 may be positioned upstream of the plate 34 and/or downstream from the plate 34.

As shown in FIG. 1, the fuel plenum 38 may be positioned between the end cap 28 first surface 30 and the plate 34 within the first diluent plenum 48. As shown in FIG. 2, the fuel plenum 38 may at least partially surround one or more of the plurality of tubes 36. The fuel plenum 38 may be connected, for example, by brazing or welding, to one or more of the plurality of tubes 36 or in any suitable manner for forming a seal between the fuel plenum 38 and the tubes 36. In this manner, as fuel enters the fuel plenum 38 there may be a pressure differential between the fuel plenum 38 and the first diluent plenum 48. In particular instances, wherein the pressure within the fuel plenum 38 is generally higher than the pressure within the first diluent plenum 48, the seal may at least partially fail. As a result, the fuel may leak from the fuel plenum 38 and flow into a low velocity volume 54 created within the first diluent plenum 48. The low velocity volume 54 may generally occur between the fuel plenum 38 and the shroud 24. This may be the result of the size and/or location of the fuel plenum 38, the diluent port 52, the tubes 36 and/or other obstructions within the end cap 28. As a result, the leaked fuel may stagnate in the low velocity volume 54 and heat up, thereby increasing the risk of the fuel auto igniting within the end cap 28 and resulting in significant damage to the fuel nozzle 20 and/or the combustor 10.

At least one purge port 56 may extend through one or more of the plurality of tubes 36 within the end cap 28 and may provide fluid communication from the first and/or the second diluent plenum, 48 and 50 respectfully, into the tubes 36. In one embodiment, the purge port 56 may be axially aligned with the plate 34. In this manner, the plate 34 may direct the working fluid 14 towards the purge port 56 as the working fluid passes through the first and/or second diluent plenums, 48 and 50 respectfully, and generally across at least a portion of the fuel plenum 38. A pressure differential between the first diluent plenum 48, the second diluent plenum 50 and a fluid flowing through the tubes 36, may draw the working fluid through the purge port 56 and into the tubes 36, thereby purging the leaked fuel from the low velocity volume 54 and/or the first and second diluent plenums, 48 and 50 respectfully. In alternate embodiments, the purge port(s) 56 may be upstream and/or downstream of the one or more plates 28.

The various embodiments shown and described with respect to FIGS. 1-2 may also provide a method for purging the combustor 10. The method may include flowing the working fluid 14 through at least one of the plurality of tubes 36, flowing a fuel into the plurality of tubes 36, and flowing at least a portion of the working fluid 14 through at least one diluent plenum 48, 50 located inside the end cap 28 and into one or more of the plurality of tubes 36. The method may further include flowing the working fluid 14 through a first diluent port 52 located upstream of the plate 34 and directing the working fluid 14 across the fuel plenum 38 and into one or more of the plurality of tubes 36. The method may also include flowing a working fluid 14 through the plurality of tubes 36 and through the first diluent port 52 and directing the working fluid 14 into one or more of the plurality of tubes 36 through the one or more purge port(s) 56, wherein at least one of the one or more purge ports 56 is at least partially axially aligned with the plate 34. The method may further include flowing the fuel into the fuel plenum 38 and directing the working fluid 14 across the fuel plenum 38 and into the purge port 56, thus purging leaked fuel from the low velocity volume 54 surrounding the fuel plenum 38. In particular embodiments, the method may further include flowing the working fluid 14 through a second diluent port 52, wherein a first diluent port 52 is located upstream of the plate 34 and a second diluent port 52 is located downstream of the plate 34. The method may further include directing the working fluid 14 into one or more of the purge ports 56 upstream of the plate 34. The method may further include directing the working fluid 14 into one or more of the purge ports 56, wherein at least one of the one or more purge port(s) 56 are positioned downstream of the plate 28.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. an end cap, wherein the end cap includes a first surface and a second surface downstream from the first surface;

b. a shroud that circumferentially surrounds at least a portion of the first and second surfaces;

c. a plate that extends radially within the shroud, the plate defining a plurality of plate passages that extend axially therethrough;

d. a plurality of tubes that extend through the plate and the first and second surfaces, wherein each tube having an inlet and an outer and extend through a corresponding plate passage of the plurality of plate passage;

e. a radial gap defined between one or more of the plurality of tubes and the plate at a corresponding plate passage; and f. a first purge port that extends through a wall one or more of the plurality of tubes, wherein the first purge port is radially aligned with the plate facing the corresponding plate passage.

2. The combustor of claim 1, wherein the plate at least partially defines a first diluent plenum between the plate and the first surface.

3. The combustor as in claim 1, further comprising a first diluent port that extends through the shroud upstream from the plate.

4. The combustor of claim 1, wherein the plate at least partially defines a second diluent plenum between the plate and the second surface.

5. The combustor as in claim 1, further comprising a second diluent port that extends through the shroud downstream from the plate.

6. The combustor of claim 1, further comprising a second purge port located upstream of the plate.

7. The combustor of claim 1, further comprising a first diluent port upstream of the plate and a second diluent port downstream of the plate.

8. The combustor of claim 1, further comprising a fuel plenum surrounding the plurality of tubes, wherein the fuel plenum is located upstream of the plate and at least partially circumferentially surrounded by the shroud.

9. A combustor, comprising:

a. an end cap;

b. a plurality of tubes that extend through the end cap and provide fluid communication through the end cap, each tube having an inlet and outlet;

c. a plate that extends radially inside the end cap, the plate defining a plurality of plate passages that extend axially therethrough;

d. a radial gap defined between one or more of the plurality of tubes and the plate at a corresponding plate passage; and e. a first purge port between the plate and one or more of the plurality of tubes, wherein the first purge port extends through a wall and provides fluid communication into the one or more of the plurality of tubes, wherein the first purge port is radially aligned with the plate facing the corresponding plate passage and the radial gap.

10. The combustor of claim 9, further comprising a second purge port located upstream of the plate.

11. The combustor of claim 10, further comprising a third purge port located downstream of the plate.

12. The combustor of claim 9, further comprising a fuel plenum surrounding the plurality of tubes, wherein the fuel plenum is located upstream of the plate.

13. The combustor of claim 9, wherein the end cap includes a first surface axially separated from a downstream second surface.

14. The combustor of claim 13, further comprising a shroud extending axially from the end cap first surface to the end cap second surface, wherein the shroud at least partially surrounds the plurality of tubes.

15. The combustor of claim 14, wherein the plate at least partially defines a first diluent plenum between the plate and the first surface.

16. The combustor of claim 14, wherein the plate at least partially defines a second diluent plenum between the plate and the second surface.

17. The combustor of claim 14, further comprising a first diluent port upstream of the plate and a second diluent port downstream of the plate.

* * * * *

UNITED STATES PATENT AND TRADEMARK OFFICE

CERTIFICATE OF CORRECTION

PATENT NO. : 9,052,112 B2
APPLICATION NO. : 13/405564
DATED : June 9, 2015
INVENTOR(S) : Jonathan Dwight Berry et al.

It is certified that error appears in the above-identified patent and that said Letters Patent is hereby corrected as shown below:

In The Claims

Claim 1, column 5, line 54, reads "inlet and an outer and extend through a corresponding" should read --inlet and an outlet and extend through a corresponding--

Claim 1, column 5, line 55, reads "plate passage of the plurality of plate passage," should read --plate passage of the plurality of plate passages,--

Claim 1, column 5, line 59, reads "a first purge port that extends through a wall one or more" should read --a first purge port that extends through a wall of one or more--

Signed and Sealed this
Third Day of May, 2016

Michelle K. Lee

Michelle K. Lee
*Director of the United States Patent and Trademark Office*